US005177538A

United States Patent [19]

Mammino et al.

[11] Patent Number: 5,177,538

[45] Date of Patent: Jan. 5, 1993

[54] PHENOLIC GRAPHITE DONOR ROLL

[75] Inventors: Joseph Mammino, Penfield; Dennis A. Abramsohn, Pittsford; Donald S. Sypula, Penfield, all of N.Y.

[73] Assignee: Xerox Corporation, Stamford, Conn.

[21] Appl. No.: 766,308

[22] Filed: Sep. 27, 1991

[51] Int. Cl.[5] ..... G03G 15/08

[52] U.S. Cl. ..... 355/259; 118/653

[58] Field of Search ..... 355/245, 259, 211; 118/653

[56] References Cited

U.S. PATENT DOCUMENTS

| | | | |
|---|---|---|---|
| 3,754,963 | 8/1973 | Chang . | |
| 3,996,892 | 12/1976 | Parker et al. . | |
| 4,459,009 | 7/1984 | Hays et al. . | |
| 4,568,955 | 2/1986 | Hosoya et al. . | |
| 4,774,541 | 9/1988 | Martin et al. . | |
| 4,806,992 | 2/1989 | Yasuda et al. . | |
| 4,899,689 | 2/1990 | Takeda et al. . | |
| 4,967,231 | 10/1990 | Hosoya et al. . | |
| 4,982,689 | 1/1991 | Honda et al. . | |
| 4,990,963 | 2/1991 | Yamamoto et al. | 355/259 |

FOREIGN PATENT DOCUMENTS

| | | | |
|---|---|---|---|
| 1-99072 | 4/1989 | Japan | 355/245 |
| 1-267577 | 10/1989 | Japan | 355/259 |
| 1-267578 | 10/1989 | Japan | 355/259 |
| 2-18567 | 1/1990 | Japan | 355/211 |
| 2-18580 | 1/1990 | Japan | 355/259 |

OTHER PUBLICATIONS

"Stock Shapes Extend Designers' Options", by Mel Friedman, editor., Plastics Design Forum, Jul./Aug. 1986.

*Primary Examiner*—Joan H. Pendegrass
*Attorney, Agent, or Firm*—Oliff & Berridge

[57] ABSTRACT

A printer has a donor roll formed by mixing resin particles with conductive particles and subsequently extruding or centrifugally casting the mixture into a cylindrical shell. The shell is cut to the desired length and journals are attached to each end of the shell. The resin particles are thermoset particles preferably phenolic resin particles, and the conductive particles are preferably graphite particles.

18 Claims, 5 Drawing Sheets

PHENOLIC GRAPHITE DONOR ROLL

BACKGROUND OF THE INVENTION

The present invention is generally directed to donor rolls and more specifically, the present invention is directed to donor rolls made from a graphite loaded phenolic resin. The donor rolls of the present invention are useful in a number of imaging processes including electrostatographic imaging systems.

The development of images by various methods, including electrostatographic means, is well known. In several of these methods, toner particles are deposited on an electrostatic latent image present on an insulating surface, such as selenium, utilizing, for example, cascade development, magnetic brush development, powder cloud development, and touchdown development. In view of several disadvantages associated with two-component systems, considerable effort has been directed to designing processes which utilize toner particles only.

In many of the single component development processes, conductive toner particles are selected, and imagewise toner deposition onto the photoconductive member is obtained by induction charging of the toner particles. Electrostatic transfer of conductive toner particles to plain bond paper is, however, usually inefficient as the charge on the toner particles can be reversed by induction charging from the paper during the transfer step. Accordingly, electrophotographic systems wherein conductive single component toner particles are used can require a special overcoated insulating paper to achieve sufficient electrostatic toner transfer. Furthermore, in single component processes with conductive toner particles the control of undesirable background, or background suppression, cannot usually be achieved with electrostatic forces as the toner particles are inductively charged, and deposited on the image bearing member, which is not the situation with two-component developer processes where control of background development is accomplished by electrostatic forces acting on the triboelectrically charged toner particles, causing these particles to be directed away from image bearing members.

Recently, there has been disclosed an efficient, single component, economical, simple process, and apparatus for the development of latent electrostatic images wherein insulative, nonmagnetic, or color toner particles are appropriately charged; and there is obtained two-component image quality utilizing a single component development apparatus. In this system, as detailed hereinafter, and as described in U.S. Pat. No. 4,459,009, there is selected a charging roll means which simultaneously meters and charges toner particles. A donor electrode serves to transport the toner particles, which electrode can be comprised of numerous suitable materials, including for example, aluminized Mylar overcoated with a polymer containing carbon black, electroformed nickel, or a carbon black loaded extruded polymer. While these materials may be satisfactory for their intended purposes, there continues to be a need for a donor roll with improved characteristics for applying toner to the charged photoreceptor.

Furthermore, known prior art donor rolls such as Krylon, available from Borden, Inc., coated onto a nickel substrate, although suitable for their intended purposes are not scratch resistant over extended time periods. Thus, these coatings permit scratches to form on the toner transporting means, which in turn adversely affects image copy quality. Additionally, toner particles appear to permanently adhere to the surface of transporting members with Krylon coatings which adhesion results in undesirable high background deposits on the resulting developed images.

It is also known to form a developing member incorporating a dielectric material in which conductive particles are dispersed. As described in U.S. Pat. No. 4,990,963 to Yamamoto et al., developing rollers are known which are formed by pouring or spraying a solvent/resin/conductive particle solution. The volatile portion of the solution is evaporated leaving a resin/-conductive particle substrate for use in a developer roller.

SUMMARY OF THE INVENTION

It is an object of the present invention to provide a process for making a single layer extruded or cast development donor roll.

It is another object of the present invention to provide a process for making a single layer extruded or cast development donor roll extruded/cast from a mixture of thermoset resin and graphite particles.

It is yet another object of the present invention to provide a process of making a donor roll having improved weight, durability, toner tribo charging characteristics and toner loading characteristics.

It is a still a further object of the present invention to provide an electrophotographic printing system having a developer sump with a donor roll that is of lower cost and ease to manufacture.

Another object of the present invention is to provide an electrostatographic printing system which utilizes a donor roll extruded or cast from a thermoset resin and conductive particles.

Yet another object of the present invention is to provide a donor roll and a process for making a donor roll by extruding or centrifugal casting a composition of a thermoset phenolic resin and graphite particles into a tubular shape, counterboring the inside ends of the tube to press fit or adhesively fasten journals, and grinding the outside surface of the tube to achieve the desired surface finish, diameter, straightness, runout, and other mechanical tolerance requirements.

BRIEF DESCRIPTION OF THE DRAWINGS

The foregoing and other objects, features and advantages of the invention will be apparent from the following more detailed description of preferred embodiments of the invention in conjunction with accompanying drawings wherein.

DETAILED DESCRIPTION OF THE PREFERRED EMBODIMENTS

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
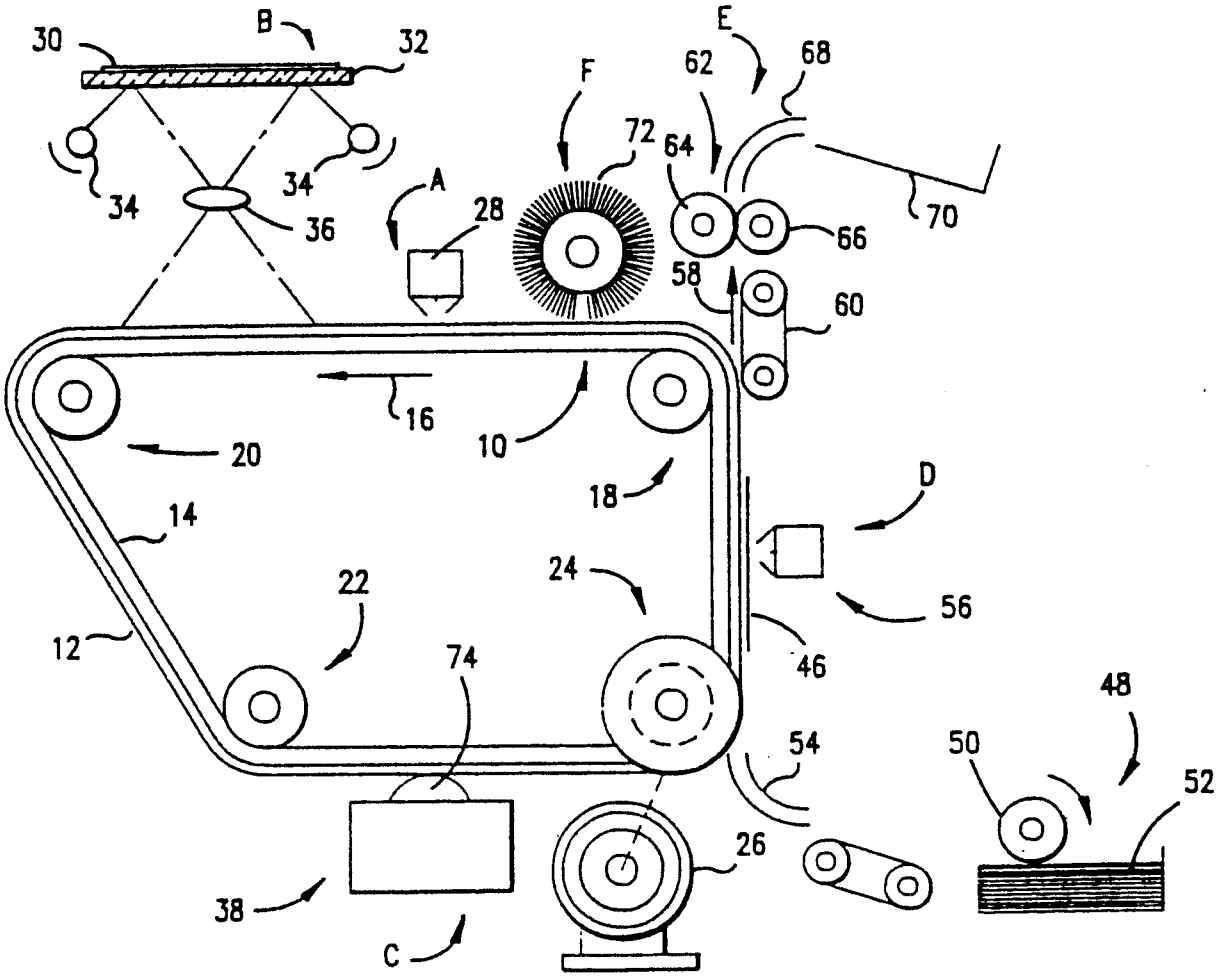
FIG. 1 is a schematic elevational view depicting an electrophotographic printing machine incorporating the donor roll of the present invention.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the donor roll of the present invention therein. It will become evident from the following discussion that this donor roll is equally well suited for use in a wide variety of printing machines and is not necessarily limited in its application to the particular embodiment depicted herein.

1. Electrophotographic Printing Using Donor Rolls

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from a nickel alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to informational areas contained within original document 30 disposed upon transparent platen 32. Thereafter, belt 10 advances the electrostatic latent image recorded on photoconductive surface 12 to development station C.

At development station C, a developer unit, indicated generally by the reference numeral 38, transports a single component developer material of toner particles into contact with or in close proximity to the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 2.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the electrostatic charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

The foregoing description is sufficient for purposes of the present application to illustrate the general operation of an exemplary electrophotographic printing machine incorporating the features of the present invention therein.

Figure 2:
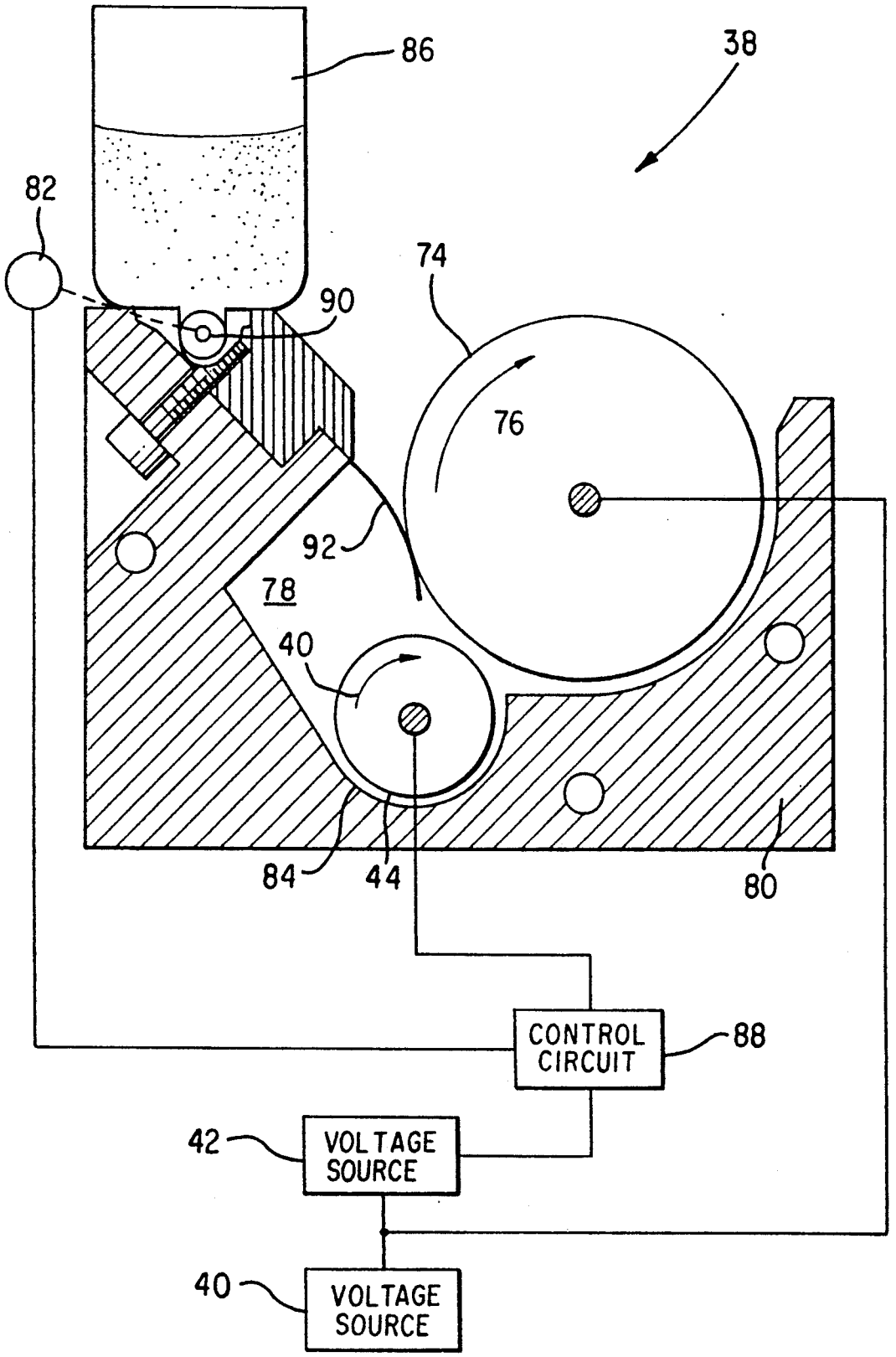
FIG. 2 is a schematic elevational view showing the development apparatus used in the FIG. 1 printing machine.

Referring now to FIG. 2, the detailed structure of developer unit 38 is shown. The developer unit includes a donor roller 74. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor which rotates donor roller 74 in the direction of arrow 76. Donor roller 74 is positioned, at least partially, in chamber or sump 78 of housing 80.

A toner mixer, indicated generally by the reference numeral 44, mixes and fluidizes the toner particles. The fluidized toner particles seek their own level under the influence of gravity. Inasmuch as new toner particles are being discharge from container 86 into one end of the chamber 78 of housing 80, the force exerted on the fluidized toner particles by the new toner particles being added at that end moves the fluidized toner particles from that end of housing 80 to the other end thereof. Toner mixer 44 is an elongated member located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are discharged into one end of chamber 78 from container 86. As elongated member 44 rotates in the direction of arrow 40, toner particles are mixed and fluidized. The force exerted on the fluidized toner particles by the new particles being discharged into chamber 78 advances the fluidized toner particles from the end of the chamber in which the new toner particles have been discharged to the other end thereof. The fluidized toner particles being moved are attracted to donor roller 74.

Voltage source 42 is electrically connected to elongated member 44 by control circuit 88. Voltage source 40 is connected to voltage source 42 and donor roll 74. Voltage sources 40 and 42 are DC voltage sources. This establishes an electrical bias between donor roll 74 and toner mixer 44 which ranges from about 260 volts to about 1000 volts. Preferably, an electrical bias of about 600 volts is applied between donor roller 74 and toner mixer 44. The current biasing the toner mixer is a measure of toner usage. Control circuit 88 detects the current biasing the toner mixer 44 and, in response thereto, generates a control signal. The control signal from control circuit 88 regulates the energization of motor 82. Motor 82 is connected to auger 90 located in the open end of container 86. As auger 90 rotates, it discharges toner from container 86 into chamber 78 of housing 80. Toner mixer 44 is spaced from donor roller 74 to define a gap therebetween. This gap may range from about 0.05 centimeters to about 0.15 centimeters.

Donor roller 74 rotates in the direction of arrow 76 to move the toner particles attracted thereto into contact with or in close proximity to the electrostatic latent image recorded on photoconductive surface 12 of belt 10. As donor roller 74 rotates in the direction of arrow 76, charging blade 92 has the region of the free end thereof resiliently urged into contact with donor roller 74 Charging blade 92 may be made from a metal, silicone rubber, or a plastic material. By way of example, charging blade 92 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 92 is maintained in contact with donor roller 74 at a pressure ranging from about 10 grams per centimeter to about 250 grams per centimeter. The toner particle layer adhering to donor roller 74 is charged to a maximum of 60 microcoulombs/gram with the toner mass adhering thereto ranging from about 0.1 milligrams per centimeter$^2$ to about 2 milligrams per centimeter$^2$ of roll surface.

Figure 3:
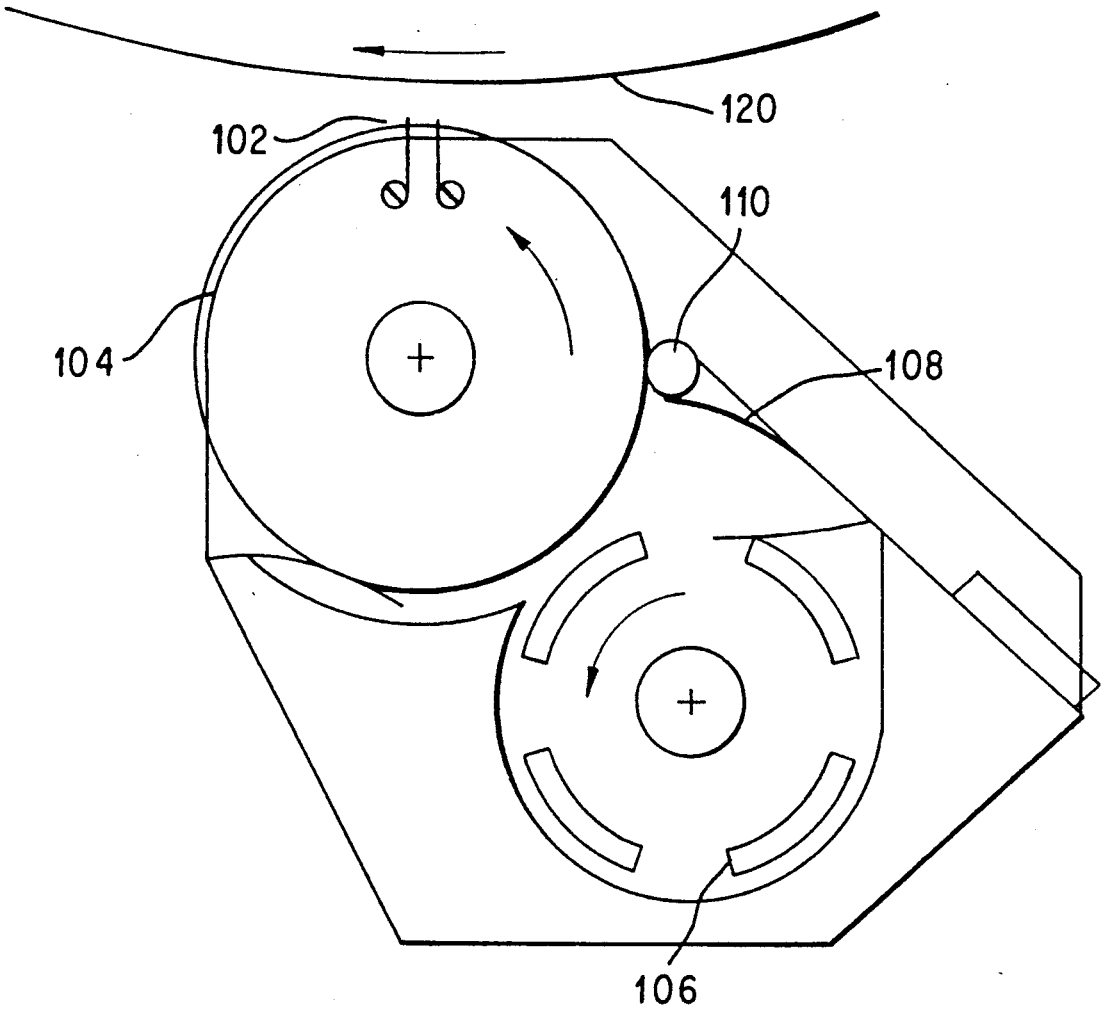
FIG. 3 is a schematic elevational view showing an alternative development apparatus to that shown in FIG. 2.

The charging function can be achieved by a rotating rod in contact with and axially parallel to the donor roll. As can be seen in FIG. 3, self spaced wires 102 are used to create a controlled toner cloud near the surface of the photoreceptor 120. A blade 108 with a rotating charge rod 110 charges the toner particle layer supplied by the toner supply tube 106 onto the surface of donor roller 104. In operation, non magnetic toner is metered and charged on donor roll 104 by the small diameter rotating charge rod 110. Charge rod 110 rotates at a fraction of the surface speed of the donor roll and in the reverse direction. Toner is metered to a mono layer and tribocharged. Flexible electrodes, such as corotron wires 102, are in self-spaced contact with the toned donor roll in the development nip gap. Low AC voltage applied between the wires and the donor roll breaks toner-donor adhesive bonds to form a localized cloud, while the DC image potential controls projection to the receiver.

Many different materials are known for use in the manufacture of donor rollers. Donor rollers can be made from aluminum, nickel or steel. Alternatively, donor rollers can be made of an anodized metal or a metal coated with a material. For example, a polytetrafluoroethylene based coating composition such as Teflons, a trademark of the Du Pont Corporation, or a polyvinylidene fluoride based resin, such as Kynar, a trademark of the Pennwalt Corporation, may be used to coat the metal roller. Such a coating acts to assist in charging the particles adhering to the surface thereof. Still another type of known donor roller is a stainless steel plated by a catalytic nickel generation process and impregnated with Teflon. The surface of the donor roller can be roughened from a fraction of a micron to several microns, peak to peak.

2. Donor Rolls

Many of the above-noted donor rolls are made by spray or dip coating a metal core. The graphite loaded thermoset donor roll of the present invention, however, is made by an extrusion or centrifugal casting process.

The use of evaporative solvents in the prior art can cause a number of deficiencies in the donor roll. The use of evaporative solvents is helpful for allowing the spraying, dipping or pouring of a resin, and the subsequent drying of the resin upon the evaporation of the solvent. The evaporation of the solvent, however, creates voids within the resin which effect the quality of the donor roll when used in a printing process. The voids left by the evaporated solvent result in a discontinuity of particles in the resin binder, which in turn results in an electrical discontinuity of the donor roll. Areas deficient in conductive particles will lack development in those areas and result in an undesirable change in the image density.

The use of evaporative solvents also results in the settling of conductive particles such that an electrical gradient results in the donor roll. In some applications, an electrical gradient which naturally results from spraying or pouring solvent/resin/conductive particle solutions is undesirable. For example, when it is desired to machine the outer diameter of the donor roll to an exact dimension, the change in outer diameter results in a change in the electrical conductivity of the surface of the donor roller, thus resulting in lack of control of the surface conductivity.

Figure 4:
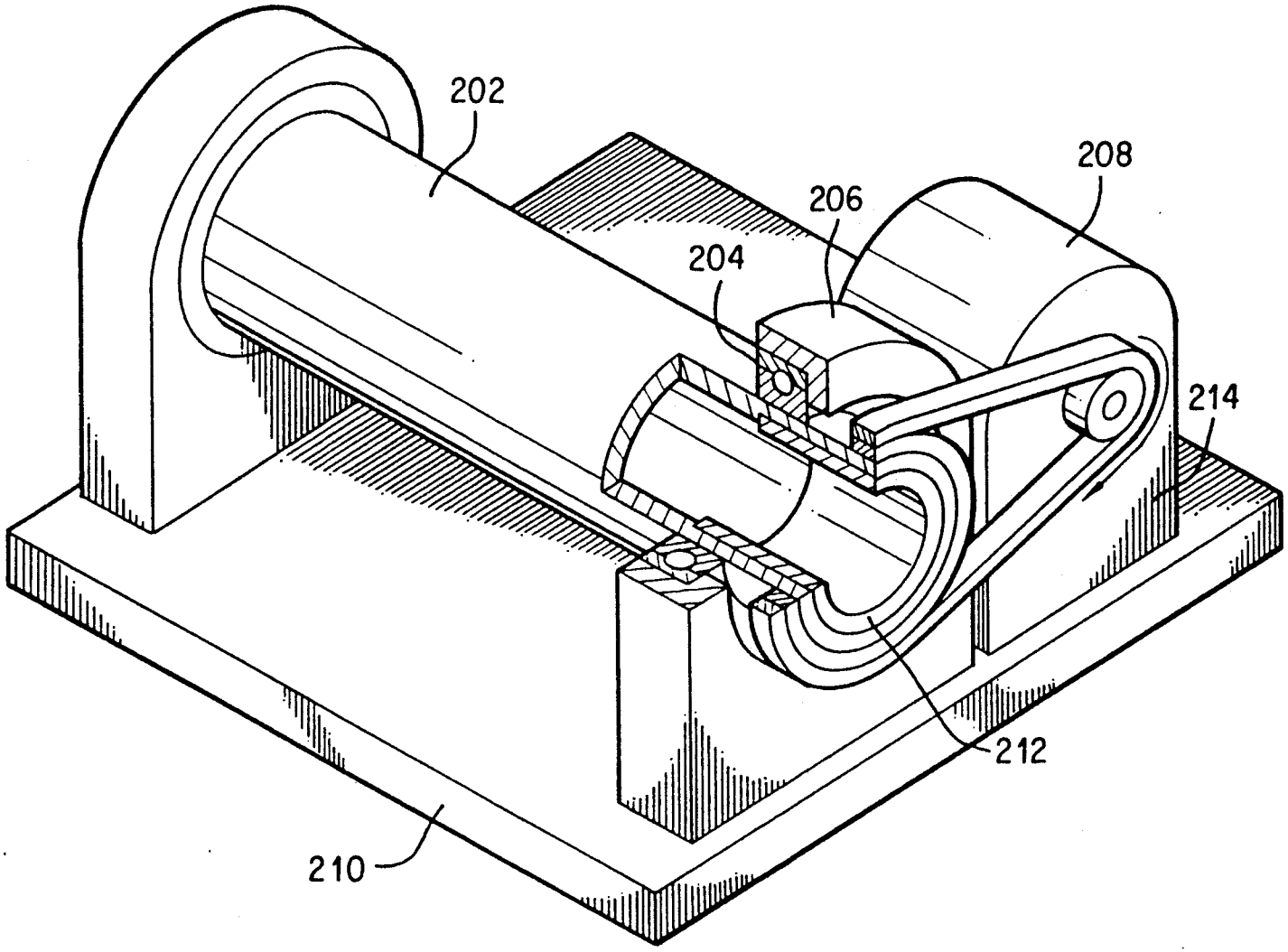
FIG. 4 is a view of a centrifugal casting apparatus for forming the donor roll of the present invention.

In the present invention, donor rolls are made by centrifugal casting or extrusion to avoid the degradation in printed image quality due to evaporative solvents. For centrifugal casting, a liquid curable thermoset resin having a conductive filler mixed therein, is introduced into a rotating cylindrical mold and allowed to cure. A rigid drum is produced in the mold which matches the dimensional character and surface quality of the interior of the mold. As can be seen in FIG. 4, a belt driven centrifugal mold 202 rests upon tooling plate 210 and is driven by air motor 208 on support flange 214. High speed ultra-precision bearings 204 allow mold 202 to rotate at high speed within bearing housing 206. The centrifugal casting method results in a donor roll having very tight dimensional tolerances equal to those of the mold. In addition, the donor roll has excellent surface quality, low UMC, excellent mechanical properties, high temperature resistance and good solvent resistance. In addition, it is possible to homogeneously disperse conductive particles and at high loadings.

Whether centrifugal casting or extrusion is used to produce the donor roll of the present invention, the preferred resin is a thermoset resin. Extruded thermosets, like centrifugally casted thermosets, have superior dimensional stability, outstanding heat resistance, and higher mechanical strengths. In the extrusion process, high pressure and a uniform melt history result in a highly cross-linked thermoset with improved uniformity. The high density roll made from an extrusion process has low porosity and thus improved electrical continuity.

The main categories of thermosets are phenolic, melamine, epoxy, DAP (diallyl phthalate resin), ureas, alkyds, and polyesters. Thermosets are cross-linked and have relatively low viscosities until they are cured. By definition, a thermoset is heat-hardenable, and once hardened will not remelt. Phenolics are relatively inexpensive, heat and flame resistant, dimensionally stable, and blend themselves well to compounding and easy molding. Phenolics are the preferred thermoset resin in the present invention. However, other thermosets are usable in the present invention as well. Melamine has a high resistance to scratches, epoxy has good chemical resistance and DAP has longterm dimensional stability, and polyesters have good electrical properties and are impact resistant.

Figure 5:
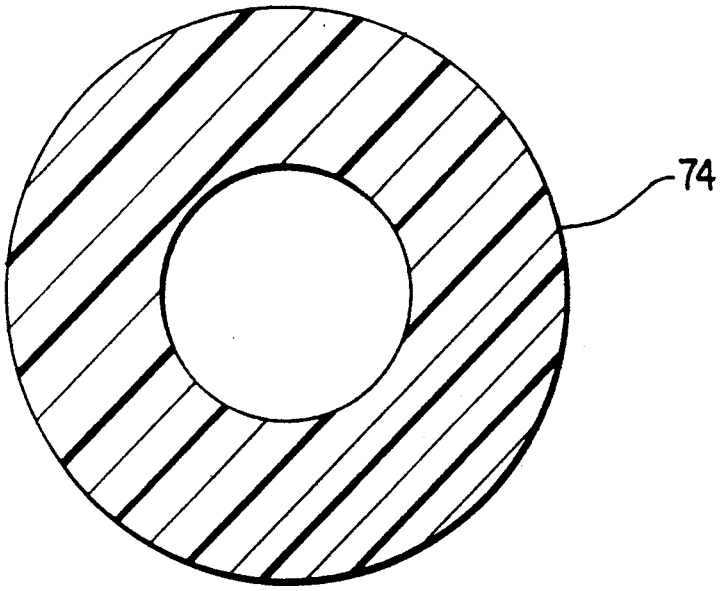
FIG. 5 is a cross sectional view of the extruded or cast donor roll.

Carbon particles, such as fluorinated carbon or graphite particles, can be used as the conductive particulate. Also envisioned is the use of graphite particles mixed with other conductive particles which provide some lubricity in the extrusion process, such as zinc oxide, titanium oxide, tin oxide or molybdenum disulfide. As in FIG. 5, the resulting phenolic resin/graphite extruded tube 74 is homogenous without any noticeable loading gradient after surface grinding.

Thermoset tubes of approximately 26.6 millimeters outer diameter with an approximately 1 to 5 millimeter wall thickness can be made by casting or extruding. The conductive particles comprise from 6 to 25 weight % of the original particulate mixture, and preferably from approximately 6 to 15 weight % of the original mixture. After extrusion, the tube can be cut to the desired length. The inside diameter of each tube is preferably counterbored, with journals being press fitted into each end of the tube. Subsequently, the outside surface of the graphite loaded phenolic tube is surface ground to a final 25 millimeter outer diameter, with a wall thickness of approximately 1.6 millimeters at the journal ends. A straightness of approximately 0.025 millimeters and a runout of less than 0.05 millimeters can be achieved. The resistivity of the finish ground rolls should be preferably less than $10^2$ ohm.cm., and preferably from approximately $10^1$ ohm.cm. to about $10^9$ ohm.cm. A donor roll of the above-described dimensions weighs approximately 186 grams, in comparison to a similarly sized aluminum roll coated with Teflon which weighs approximately 352 grams, or in comparison to a typical phenolic roll with a solid steel shaft center which weighs 869 grams.

EXAMPLE 1

The phenolic graphite rolls of the present invention were tested in a developer housing and were compared to a Teflon-S coated aluminum roll and a phenolic roll fabricated with a solid steel shaft through the phenolic roll center (and having journals at each end) as controls.

Test Roll Conditions

| | |
|---|---|
| Toner Materials: | Black toner made of 90% styrenebutadiene (available from Goodyear), 8% Regal 330 carbon black (available from Cabot Corp.), 2% dodecyldimethyl-ammonium sulfate (a toner charge control agent) + 1% of a surface treated silica used as a flow aid. |
| Roll Speeds: | Donor roll 8 in./sec., charge rod 4 in./sec., toner mover 15 in./sec. |
| Voltages: | Donor roll at zero, toner mover at +1000 V, charge rod at +100 V. |
| Procedure: | Toner was introduced into the developer housing and run for approximately 15 minutes to equilibrate. Toner samples were then picked off the donor roll with a standard Faraday cage. |

There was a one minute run time between samples. The test results were:

| | Q/M μc/g | mass/area (middle of roll) mg/cm² | mass/area (left side of roll) mg/cm² | mass/area (right side of roll) mg/cm² |
|---|---|---|---|---|
| Phenolic (15% Graphite) | +9.1 | .45 | .45 | .41 |
| Phenolic (20% Graphite) | +9.9 | .49 | .55 | .49 |
| Phenolic (25% Graphite) | +10.0 | .39 | .45 | .60 |
| Typical Teflon-S Coating Roll | +10.0 | .36 | .40 | .38 |
| Typical Phenolic Roll | 9.4 | .44 | .45 | .45 |

The test results show that each of the phenolic graphite rolls of the present invention tribo charge the toner to about an equivalent level and is about the same as the tribo of each of the control rolls. The toner mass coverage for the phenolic graphite rolls was also generally higher than for each of the control rolls as well. Toner uniformity around and across the length of the roll was better than for Teflon-S coated rolls. Charge spectra of toner on phenolic rolls showed a narrower charge distribution when compared to Teflon-S donor rolls. The phenolic rolls with the graphite loadings showed a wider acceptable latitude when compared to the typical phenolic roll.

The invention has been described in detail with particular reference to preferred embodiments thereof, but it will be understood that variations and modifications can be affected within the spirit and scope of the invention as described herein above and as defined in the appended claims.

What is claimed is:

1. An electrostatographic printer comprising:

a photoreceptor;

charging means for creating a latent image on said photoreceptor;

developer applying means for applying developer material to said photoreceptor;

transfer means for transferring said applied developer material to a sheet of support material;

wherein said developer applying means comprises:

a donor roll in a developer sump, the donor roll comprising a homogenous mixture of a thermoset and a conductor, said roll comprising from about 6% to about 25% by weight of conductor.

2. The printer of claim 1, wherein said donor roll is and extruded or centrifugally cast roll.

3. The printer of claim 1, wherein said thermoset is a resin selected form phenolic, melamine, epoxy, diallyl phthalate, urea, alkyds and polyesters.

4. The printer of claim 3, wherein said conductor of said roll comprises graphite particles or fluorinated carbon particles.

5. The printer of claim 4, wherein said donor roll mixture further comprises a lubricant.

6. The printer of claim 1, wherein said thermoset is a phenolic resin and said conductor is particulate graphite.

7. The printer of claim 1, wherein said roll comprises from about 6% to about 15% by weight of conductor.

8. The printer of claim 1, wherein said roll is a seamless extruded cylinder.

9. The printer of claim 1, wherein said roll is a seamless centrifugally cast cylinder.

10. The printer of claim 1, wherein the surface resistivity of said donor roll is less than $10^{11}$ ohm.cm.

11. The printer of claim 10, wherein the surface resistivity of said donor roll is approximately from $10^{1}$ ohm.cm. to $10^{9}$ ohm.cm.

12. The printer of claim 1, wherein said roll has a wall thickness of approximately 1.6 mm.

13. The printer of claim 1, wherein said donor roll further comprises journals press-fitted into each end of said roll.

14. The printer of claim 13, wherein said thermoset is a resin selected from the group consisting of phenolic, melamine, epoxy, dialkyl phthalate, urea, alkyls and polyesters.

15. The printer of claim 13, wherein said conductor comprises graphite particles or fluorinated carbon particles.

16. An electrostatographic printer comprising:

a photoreceptor;

charging means for creating a latent image on said photoreceptor;

developer applying means for applying developer material to said photoreceptor;

transfer mean for transferring said applied developer material to a sheet of support material;

wherein said developer applying means comprises:

a donor roll in a developer sump, the donor roll comprising a homogeneous mixture of a thermoset and a conductor, said donor roll mixture further comprises a lubricant selected from zinc oxide, titanium oxide, tin oxide and molybdenum disulfide.

17. An electrostatographic printer comprising:

a photoreceptor;

charging means for creating a latent image on said photoreceptor;

developer applying means for applying developer material to said photoreceptor;

transfer means for transferring said applied developer material to a sheet of support material;

wherein said developer applying means comprises:

a donor roll in a developer sump, the donor roll comprising a homogeneous mixture of a thermoset, a conductor and molybdenum disulfide.

18. The printer of claim 17, wherein said thermoset is a phenolic resin and said conductor is particulate graphite.

* * * * *